US005695166A

United States Patent [19]

Watts

[11] Patent Number: 5,695,166

[45] Date of Patent: Dec. 9, 1997

[54] POST SUPPORT

[76] Inventor: Andrew Douglas Watts, 83 Lake Road West Roath Park, Cardiff, United Kingdom, CF2 5PJ

[21] Appl. No.: 343,593

[22] PCT Filed: May 28, 1993

[86] PCT No.: PCT/GB93/01123

§ 371 Date: Jan. 25, 1995

§ 102(e) Date: Jan. 25, 1995

[87] PCT Pub. No.: WO93/24722

PCT Pub. Date: Dec. 9, 1993

[30] Foreign Application Priority Data

Jun. 1, 1992 [GB] United Kingdom ..... 92 11510

[51] Int. Cl.[6] ..... E04C 3/30; E04H 12/22

[52] U.S. Cl. ..... 248/519; 52/736.4; 248/300; 248/530; 403/289

[58] Field of Search ..... 248/300, 519, 248/530; 52/736.1, 736.3, 736.4, 738.1; 403/289, 344

[56] References Cited

U.S. PATENT DOCUMENTS

| | | | |
|---|---|---|---|
| 982,380 | 1/1911 | Martin | 52/736.4 X |
| 1,155,589 | 10/1915 | McDonald | 248/530 X |
| 1,244,119 | 10/1917 | Mulnix et al. | 52/736.4 |
| 3,785,107 | 1/1974 | Garretson | 52/736.4 X |
| 4,242,822 | 1/1981 | Black | 248/530 X |
| 4,874,149 | 10/1989 | Miceli | 248/530 |

FOREIGN PATENT DOCUMENTS

| | | |
|---|---|---|
| 2535361 | 10/1982 | France . |
| 713309 | 11/1941 | Germany . |
| 948524 | 2/1964 | United Kingdom . |
| 2222615 | 3/1990 | United Kingdom . |

*Primary Examiner*—Ramon O. Ramirez
*Assistant Examiner*—Derek J. Berger
*Attorney, Agent, or Firm*—Scully, Scott, Murphy & Presser

[57] ABSTRACT

A post support includes a box section which is open at at least one end to receive a post, wherein the material of the box section at a wall location of the box section is horizontally slit in a plurality of axially spaced locations to provide either at least two spaced pairs of tabs of wall material, or a single pair of tabs positioned at a substantially central location axially of the box section, the free ends of which tabs or flaps are bent outwardly away from the wall of the box section to form fixing flanges such that bringing together of a pair of flanges by a fixing means, for example, a bolt passing through holes in said pair of flanges, compresses the tabs or flaps inwardly of the wall of the box section thus decreasing the cross-sectional dimensions of the box section in at least two spaced locations or at a single substantially centrally positioned location.

6 Claims, 1 Drawing Sheet

POST SUPPORT

Figure 1:
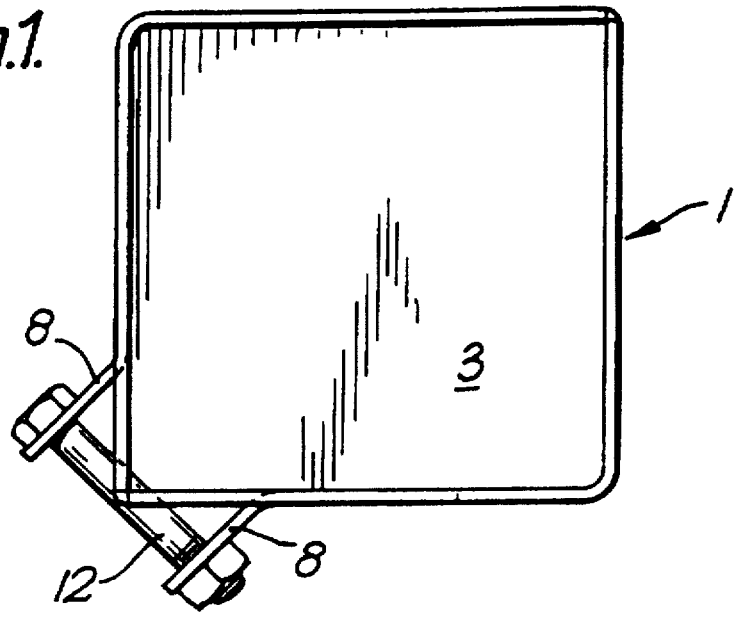

This invention relates to post supports and more particularly to a post support of the type which incorporates a box section which is open at at least one end for receiving and supporting a post, for example, a post support of the type described in GB-A-1461802.

Wooden fence posts although cut to nominal size are frequently undersized so that when introduced into a box section of fixed dimensions they have a degree of freedom of movement and the effect of such movement can loosen the post support. GB-A-2140057 relates to a post support in which this problem is avoided by forming the insde of the box section with upstanding projections. Such post supports are entirely satisfactory in use but in certain circumstances it may be difficult to introduce a post into the box section especially if the post is of extremely hard wood such as well weathered oak.

A further form of post support has been proposed in which a portion of the wall of the box section is split vertically over substantially the whole height of the box section and the cut edges are turned outwardly to form flanges, bolts are passed through holes at the top and bottom of the flanges so that by tightening the bolts the flanges can be drawn together thus reducing the cross-sectional dimensions of the box section so that an undersized post received in the box section can be securely held.

Post supports with this sort of box section are open to the disadvantage that in the event of bolt failure or bolt loosening the integrity of the box section may be lost so that the post becomes extremely loosely held and may even, if sufficient force is applied to bend the wall of the box section, fall over with consequent risks of damage to persons or property.

Another form of post support with a rectangular box section has been proposed in GB-A-2222615 in which the box section is formed from a single piece of sheet metal such that at the open end of the box section a portion of one wall of the box section includes an adjusting portion comprising a pair of limbs which are adapted for co-operation with a fastener by means of which the limbs can be flexed relative to the walls and tightened onto a post. This arrangement is unsatisfactory because the bottom of the post is still free to move with the adjusting portion providing a pivot. Moreover, adjustment forces the post against the opposite wall of the box section so that there may still be a degree of freedom for the post to move in a horizontal direction perpendicularly to the direction of compression.

According to the invention a post support includes a rectangular box section which is open at at least one end to receive a post, wherein the material of the box section at a corner location of the box section is horizontally slit in a plurality of axially spaced locations to provide either at least two spaced pairs of tabs or flaps of wall material, or a single pair of tabs or flaps positioned at a substantially central location axially of the box section, the free ends of which tabs or flaps are bent outwardly away from the wall of the box section to form fixing flanges such that bringing together of a pair of flanges by a fixing means, for example, a bolt passing through holes in said pair of flanges, compresses the tabs or flaps inwardly of the wall of the box section thus decreasing the cross-sectional dimensions of the box section in at least two spaced locations or at a single substantially centrally positioned location, the material of the box section in said corner location being continuous except in the region of said tabs or flanges. By means of the invention, an undersized post can be securely held within the box and, in the event of failure of the fixing means, the integrity of the box section is maintained because the material of the corner of the box either is continuous at least in the region between two pairs of tabs or flaps, and optionally also above and below each pair, or is continuous in the region above and below a single pair of tabs or flaps.

When there are at least two pairs of tabs or flaps these preferably comprise a first pair at or towards the open, post receiving, end of the box section with each tab or flap being defined either by a horizontal slit and the edge of the open end of the box section or by two substantially parallel horizontal slits, and a second pair towards the other end of the box section and each preferably being defined by two substantially parallel horizontal slits, the lower most of which is spaced from the bottom edge of the box section. If desired further pairs of tabs or flaps may be provided in between these first and second pairs.

Because the tabs or flaps are formed in a corner location of the box section, compression of the tabs or flaps causes the post to be forced into the opposite corner which provides the additional advantage that the post can be securely held against movement in all directions.

The post support of the invention will normally be provided with means by which it can be securely fixed to an underlying surface. Such means may, for example, comprise horizontal flanges in the case of "bolt down" or "cement-in" post support or may include an elongate member or members that can be driven into the ground. Alternatively the post support may comprise a post extension member comprising an open ended sleeve in which case both the first and second pairs of tabs or flaps may be defined by a single slit and the edge of the box section.

The invention is also applicable to box sections of cross section other than rectangular, for example, of triangular or rounded section. In the case of a triangular box section the tabs or flaps will again be formed in a corner region of the box section. In the case of a rounded box section the tabs or flaps cannot, of course, be formed in a corner region but they will normally be formed on a line of weld, for ease of production of such a box section.

Figure 2:
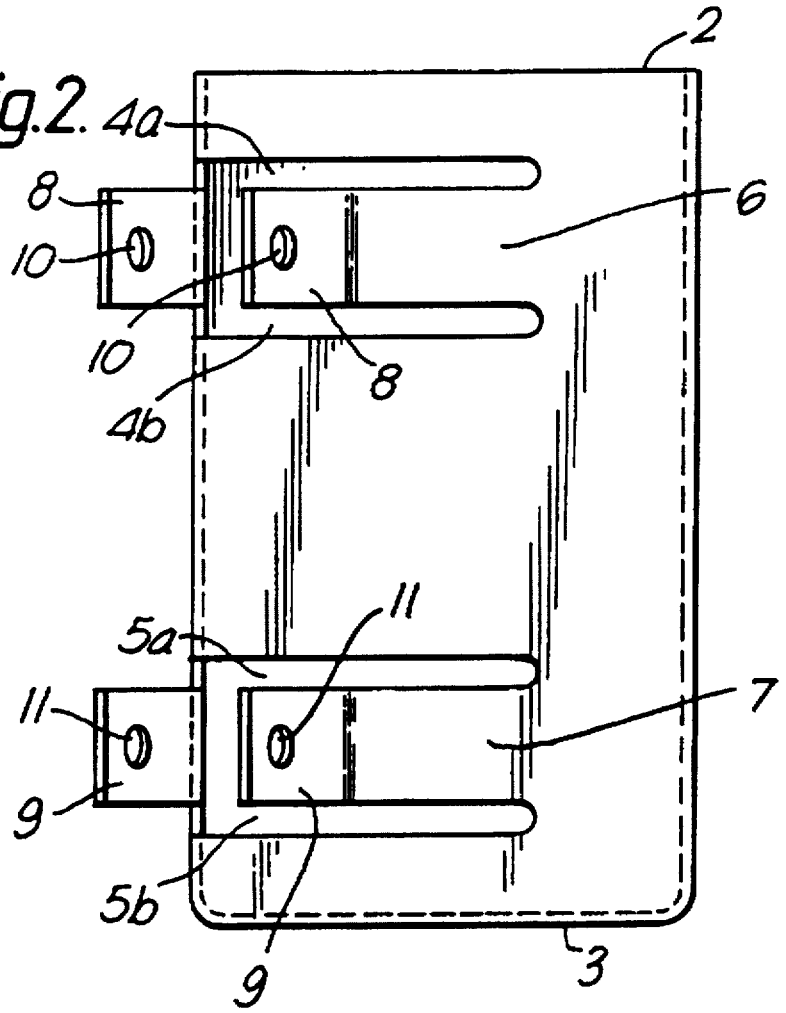

The invention will now be described in greater detail by way of example with reference to the drawings in which:

FIG. 1 is plan of the box section of one form of post support according to the invention; and FIG. 2 is a side elevation of the box support of FIG. 1.

As shown in the drawing a box section 1 of square section is open at its end 2 and closed at least partially at its end 3. Towards its open end 2 two spaced apart horizonal cuts *4a, 4b* are made across a corner of the box section 1 and towards the other end 3 of the box section two further spaced horizontal cuts *5a, 5b* are made across the same corner. Between the pairs of cuts *4a, 4b, 5a, 5b,* vertical cuts are made along the line of the corner of the box thereby forming tabs of material 6 and 7, respectively. The free end 8 and 9 of tabs 6 and 7 respectively are bent outwardly of the material of the box and are drilled at 10 and 11 to receive bolts 12. Tightening of bolts 12 bring the pairs of flanges 8 and 9 towards one another and also forces tabs of material 6 and 7 inwardly of the box section 1 to engage with a post received in box section 1.

I claim:

1. A post support comprising a box section having a peripheral wall structure comprising a plurality of planar wall portions defining, in transverse cross-section, a square configuration having corner locations between said planar wall portions, which box section is open at at least one end to receive a post of square cross-sectional configuration having dimensions substantially in conformance with internal dimensions of said box section, wherein the peripheral wall structure of the box section at one said corner location between adjacent wall portions of the box section is horizontally slit in a plurality of axially spaced locations to provide at least a single pair of tabs positioned at least at one location axially of the box section in spaced relationship with the open end of said post support, said tabs having free ends which are bent outwardly away from the wall portions of the box section to form fixing flanges, fixing means for bringing together said flanges and compressing the tabs inwardly of the wall structure of the box section, thus decreasing the internal cross-sectional dimensions of the box section at said at least one location, the wall structure of the box section in said one corner location being continuous except in the region of said tabs.

2. A post support according to claim 1 wherein the fixing means comprises a bolt passing through aligned holes formed in said flanges.

3. A post support according to claim 1 or claim 2 wherein there are provided at least two pairs of said tabs in spaced relationship to each other, comprising a first pair of said pairs of tabs located towards the open, post receiving end of the box section at a distance from said open end, and a second pair of said two pairs of tabs located towards the other end of the box section.

4. A post support according to claim 3 wherein each tab is defined by a pair of spaced parallel slots.

5. A post support according to claim 1 wherein the box section is attached to at least one elongate member that can be driven into the ground such that the axis of the box section extends substantially vertical.

6. A post support according to claim 1, wherein said at least one location is a substantially central location axially of the box section.

* * * * *